US008253631B2

(12) United States Patent
Harihara

(10) Patent No.: US 8,253,631 B2
(45) Date of Patent: Aug. 28, 2012

(54) ANTENNA DEVICE AND WIRELESS COMMUNICATION EQUIPMENT USING THE SAME

(75) Inventor: Yasumasa Harihara, Tokyo (JP)

(73) Assignee: TDK Corporation, Tokyo (JP)

( * ) Notice: Subject to any disclaimer, the term of this patent is extended or adjusted under 35 U.S.C. 154(b) by 154 days.

(21) Appl. No.: 12/809,856

(22) PCT Filed: Dec. 17, 2008

(86) PCT No.: PCT/JP2008/072912

§ 371 (c)(1),
(2), (4) Date: Sep. 28, 2010

(87) PCT Pub. No.: WO2009/081803

PCT Pub. Date: Jul. 2, 2009

(65) Prior Publication Data

US 2011/0001672 A1 Jan. 6, 2011

(30) Foreign Application Priority Data

Dec. 21, 2007 (JP) ..... 2007-330581

(51) Int. Cl.
*H01Q 1/38* (2006.01)

(52) U.S. Cl. ..... 343/700 MS; 343/702; 343/787

(58) Field of Classification Search ..... None
See application file for complete search history.

(56) References Cited

U.S. PATENT DOCUMENTS

| | | | | |
|---|---|---|---|---|
| 5,696,517 | A * | 12/1997 | Kawahata et al. | 343/700 MS |
| 6,873,291 | B2 * | 3/2005 | Aoyama et al. | 343/700 MS |
| 6,950,072 | B2 * | 9/2005 | Miyata et al. | 343/702 |
| 2002/0140610 | A1 * | 10/2002 | Onaka et al. | 343/700 MS |
| 2003/0058173 | A1 * | 3/2003 | Yoon | 343/702 |
| 2003/0193439 | A1 * | 10/2003 | Park | 343/702 |

FOREIGN PATENT DOCUMENTS

| | | |
|---|---|---|
| JP | 09-098015 | 4/1997 |
| JP | 09-219610 | 8/1997 |
| JP | 09-223916 | 8/1997 |
| JP | 3114582 B2 | 9/2000 |
| JP | 3114605 B2 | 9/2000 |
| JP | 3331852 | 7/2002 |

* cited by examiner

*Primary Examiner* — Trinh Dinh
(74) *Attorney, Agent, or Firm* — McDermott Will & Emery LLP

(57) ABSTRACT

An object of the present invention is to obtain high radiation efficiency by strengthening electromagnetic coupling in an antenna device that supplies a radiation current by the electromagnetic coupling. An antenna device includes a substrate 110 and a conductor pattern that includes a radiation conductor 121, a feed conductor 122, and a coupling conductor 123 formed on the substrate 110. Both the feed conductor 122 and the coupling conductor 123 are formed on a side surface 115 of the substrate 110. One end 122*a* of the feed conductor 122 is connected to a feed line, and other end 122*b* is connected to a ground pattern. A coupling portion 122*b* of the feed conductor 122 is substantially U-shaped, and the coupling conductor 123 is electromagnetically coupled to the coupling portion 122*b* of the feed conductor 122. Because the feed conductor 122 is gently curved, an electric filed concentration can hardly occur. The length of the feed conductor 122 can be increased, and thus it is possible to obtain a strong electromagnetic coupling with the coupling conductor 123.

12 Claims, 18 Drawing Sheets

ANTENNA DEVICE AND WIRELESS COMMUNICATION EQUIPMENT USING THE SAME

TECHNICAL FIELD

The present invention relates to an antenna device, and more particularly relates to a conductor pattern shape of a surface-mounted antenna that is used in a cellular phone and the like. The present invention also relates to a wireless communication equipment using the antenna device.

BACKGROUND OF THE INVENTION

A compact wireless communication equipment such as a cellular phone has a built-in compact antenna device. FIGS. 18 and 19 are schematic perspective views showing examples of configuration of a conventional antenna device.

An antenna device shown in FIG. 18 includes a substrate 1 constituted by a dielectric rectangular cuboid and a linear radiation conductor 2 that is formed at a center portion of an upper surface of the substrate 1 in a lateral direction. One end of the radiation conductor 2 is connected to a feed electrode (a feed line) 4 via a gap g, and the other end of the radiation conductor 2 is connected to a ground conductor 3 that is formed on a bottom surface of the substrate 1. Because an open end of the radiation conductor 2 is electromagnetically coupled to the feed electrode 4 via a capacitance of the gap g, it can be excited in a non-contact manner with the feed line, and even when the antenna device is downsized, an impedance matching can be easily obtained (see Japanese Patent No. 3114582).

In the antenna device shown in FIG. 19, the other end of a radiation conductor 2 is bent in an L shape. A feed electrode 4 is formed on a substrate 1, which is connected to a short end of the radiation conductor 2 via the gap g. With this configuration, it is possible to increase a resonant wavelength of the antenna with respect to a chip size.

However, because the conventional antenna device shown in FIG. 18 has a structure in which ends of elongated linear conductor patterns face each other across the gap g of a predetermined width, and a range of facing each other is narrow, resulting in a problem that it is not possible to obtain a large capacitive coupling.

On the other hand, in the conventional antenna device shown in FIG. 19, because the feed conductor is formed along the longitudinal direction of the radiation conductor, the range of facing each other is relatively wide, so that it is possible to obtain a larger capacitive coupling. However, because the feed conductor is formed on both top and side surfaces of the substrate, it is necessary to secure a wide area for forming the feed conductor. Therefore, it is not possible to utilize a principle surface of the substrate in an efficient manner for the radiation conductor, resulting in a problem that the size of the entire antenna device is increased.

Further, the antenna devices shown in FIGS. 18 and 19 have a problem that the antenna characteristics are largely changed depending on a mounting position on a printed circuit board. This problem is mentioned in Japanese Patent No. 3331852, which describes that the antenna characteristics are changed depending on a change of a positional relationship between a ground pattern on the printed circuit board and the antenna device.

A phenomenon that the antenna characteristics are changed depending on the mounting position becomes prominent when the radiation conductor and the feed conductor are capacitively coupled using a gap. Therefore, to suppress the change of the antenna characteristics depending on the mounting position, it appears that the radiation conductor and the feed conductor should be coupled to each other in a method other than the capacitive coupling.

SUMMARY OF THE INVENTION

The present invention has been achieved to solve the above problems. Therefore, an object of the present invention is to achieve high radiation efficiency by strengthening electromagnetic coupling in an antenna device that supplies a radiation current by the electromagnetic coupling.

Another object of the present invention is to downsize the entire antenna device by utilizing a principle surface of a substrate with high efficiency in an antenna device that supplies a radiation current by electromagnetic coupling.

Still another object of the present invention is to provide a wireless communication equipment that uses such an antenna device.

To solve the above problems, an antenna device according to the present invention includes a substrate that is made of a dielectric or magnetic material and a conductor pattern that is formed on the substrate, wherein the conductor pattern includes a radiation conductor, a substantially U-shaped feed conductor, and a coupling conductor that is connected to one end of the radiation conductor and electromagnetically coupled to the feed conductor, the feed conductor and the coupling conductor are conductor patterns formed on a different surface from a surface on which the radiation conductor is formed, and a direction of a radiation current flowing through the radiation conductor and a direction of a feed current flowing through the feed conductor are different from each other.

A communication equipment according to the present invention includes a printed circuit board and the antenna device described above that is mounted on the printed circuit board.

According to the present invention, because the direction of the radiation current is different from directions of the feed current and an induction current, it is possible to suppress a phenomenon that those currents counteract each other. As a result, it is possible to obtain high radiation efficiency. Further, because the radiation conductor and the feed conductor are inductively coupled, antenna characteristics are less affected by the mounting position. Furthermore, the feed conductor and the coupling conductor are formed on a different surface from the surface on which the radiation conductor is formed, it is possible to secure enough length and dimension of the radiation conductor. Accordingly, because a principle surface of the substrate can be utilized with high efficiency, it is possible to downsize the entire antenna device.

In the present invention, it is preferable that one end of the feed conductor is connected to a feed line and the other end of the feed conductor is grounded. Alternatively, it is preferable that the one end of the feed conductor is connected to the feed line and the other end of the feed conductor is opened. Because impedance when the one end of the feed conductor is grounded and impedance when the one end of the feed conductor is opened are different from each other, it is possible to enhance the antenna characteristics by selecting either one of the connection states according to a condition of mounting the antenna.

Further, in the present invention, it is acceptable that the one end of the feed conductor is connected to the feed line and the other end of the feed conductor is grounded or opened via a switching unit. By switching the connection state of the feed conductor in an active manner by using the switching unit, it is possible to further enhance the antenna characteristics.

In the present invention, it is preferable that the direction of the radiation current flow and the direction of the feed current flow are substantially orthogonal to each other. With this arrangement, it is possible to suppress counteracting between the radiation current and the feed current in a more effective manner.

In the present invention, it is preferable that the substrate is substantially a rectangular cuboid shape, at least a portion of the radiation conductor is formed on a top surface of the substrate, the feed conductor and the coupling conductor are formed on a first side surface that is orthogonal to a longitudinal direction of the substrate. With this arrangement, it is possible to suppress counteracting between the radiation current and the feed current, while securing enough length and dimension of the radiation conductor. Particularly, by forming the radiation electrode on a substantially entire area of the first surface of the substrate, it is also possible to reduce an electric resistance of the radiation conductor.

It is preferable that the conductor pattern that is formed on the substrate is bilaterally symmetric with respect to a predetermined reference surface. It is preferable that the reference surface is a surface that is parallel to a side surface along a longitudinal direction of the substrate. When the conductor pattern has a symmetry in this manner, even when a direction of the antenna device is rotated by 180 degrees around an axis that is orthogonal to the top surface and the bottom surface, the shape of the conductor pattern viewed from an end side of the printed circuit board is substantially the same. Therefore, the antenna characteristics are not largely changed depending on a direction of mounting the antenna, making it possible to design the antenna easily.

In the present invention, the substantially U-shaped portion of the feed conductor can be a rounded shape that is gently curved or a bent shape that is flexed to a right angle. Particularly, when the substantially U-shaped portion of the feed conductor is a bent shape that is flexed to a right angle, it is possible to strengthen the capacitive coupling as compared to a case that it is a rounded shape that is gently curved.

As described above, according to the present invention, it is possible to increase the electromagnetic coupling in an antenna device that supplies a radiation current by the electromagnetic coupling, thereby obtaining high radiation efficiency.

Furthermore, according to the present invention, it is possible to downsize the entire antenna device by utilizing the principle surface of the substrate with high efficiency in an antenna device that supplies a radiation current by the electromagnetic coupling.

Further, according to the present invention, it is possible to provide a wireless communication equipment using the antenna device.

BRIEF DESCRIPTION OF THE DRAWINGS

FIG. 11A is a smith chart, and FIG. 11B is a VSWR characteristic diagram;

FIG. 12A is a smith chart, and FIG. 12B is a VSWR characteristic diagram;

DETAILED DESCRIPTION OF THE EMBODIMENTS

Preferred embodiments of the present invention will be described in detail hereinafter with reference to the accompanying drawings.

Figure 1:
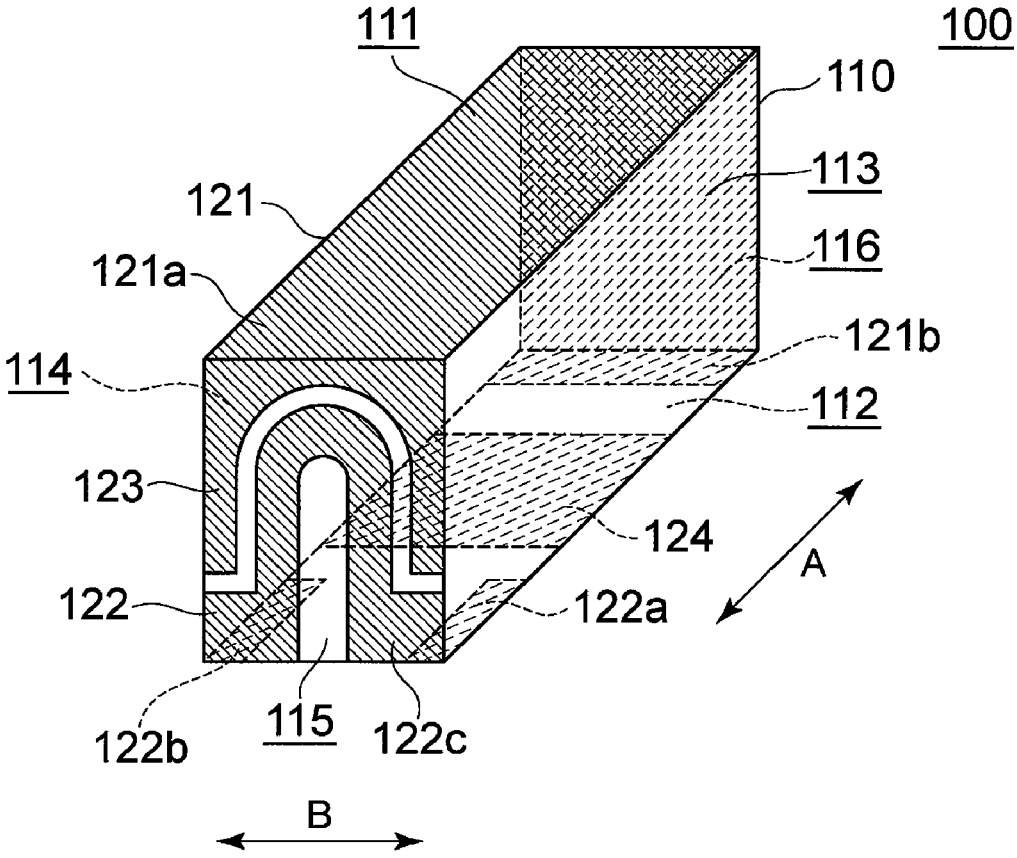
FIG. 1 is a schematic perspective view showing a structure of an antenna device 100 according to a preferred first embodiment of the present invention.
Figure 2:
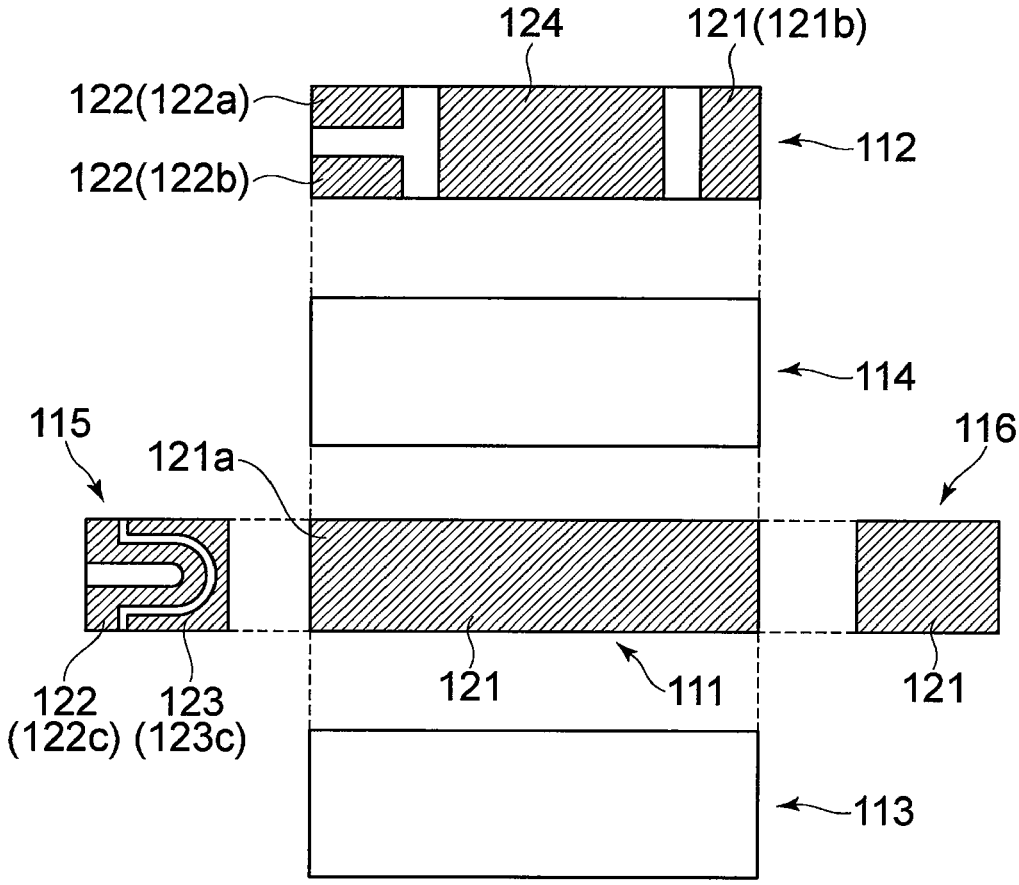
FIG. 2 is a development view of the antenna device 100.

FIG. 1 is a schematic perspective view of an antenna device 100 according to a preferred first embodiment of the present invention, and FIG. 2 is a development view of the antenna device 100.

As shown in FIGS. 1 and 2, the antenna device 100 according to the present embodiment includes a substrate 110 that is made of dielectric and a plurality of conductor patterns formed on the substrate 110. The substrate 110 has a rectangular cuboid shape with a direction A as its longitudinal direction. Therefore, the substrate 110 includes four surfaces 111 to 114 that are parallel to the direction A and two surfaces 115 and 116 that are orthogonal to the direction A. Among the surfaces, the surface 112 is a mounting surface on a printed circuit board.

As for the material for the substrate 110, although not limited to, a Ba—Nd—Ti based material (relative permittivity of 80 to 120), a Nd—Al—Ca—Ti based material (relative permittivity of 43 to 46), a Li—Al—Sr—Ti based material (relative permittivity of 38 to 41), a Ba—Ti based material (relative permittivity of 34 to 36), a Ba—Mg—W based material (relative permittivity of 20 to 22), an Mg—Ca—Ti based material (relative permittivity of 19 to 21), sapphire (relative permittivity of 9 to 10), alumina ceramics (relative permittivity of 9 to 10), and cordierite ceramics (relative permittivity of 4 to 6) can be used. The substrate 110 is fabricated by sintering these materials using a mold form.

The dielectric material can be selected appropriately according to a target frequency. As the relative permittivity $\in_r$ increases, a larger wavelength shortening effect can be obtained. However, because the efficiency decreases as the relative permittivity $\in_r$ increases, it does not necessarily mean that the larger relative permittivity $\in_r$ is preferable, but there exists a proper value for the relative permittivity $\in_r$. For example, when the target frequency is 2.4 GHz, it is preferable to use a material having the relative permittivity $\in_r$ of about 5 to 30. By using such a material, it is possible to downsize the radiation conductor while securing enough efficiency. The material having the relative permittivity $\in_r$ of about 5 to 30 preferably includes Mg—Ca—Ti based dielectric ceramics. It is particularly preferable to use Mg—Ca—Ti based ceramics containing $TiO_2$, MgO, CaO, MnO, and $SiO_2$.

The conductor patterns include a radiation conductor 121, a feed conductor 122, a coupling conductor 123, and an adjustment conductor 124. These conductor patterns can be formed by applying an electrode paste material using a method such as screen printing and transferring and then baking the applied electrode paste material under a predetermined temperature condition. Silver, silver-palladium, silver-platinum, copper and the like can be used as the electrode paste material. It is also possible to form the conductor patterns by using plating, sputtering and the like.

The radiation conductor 121 is formed on the substantially entire area of the surfaces 111 and 116 of the substrate 110, having a continuous strip structure. One end 121*a* of the radiation conductor 121 is connected to the coupling conductor 123, and other end 121*b* is connected to a ground pattern on the printed circuit board.

The feed conductor 122 is formed on a portion of the surface 115 of the substrate 110, having a continuous substantially U-shaped strip structure. One end 122*a* of the feed conductor 122 is connected to a feed line on the printed circuit board, and other end 122*b* is connected to the ground pattern on the printed circuit board.

The coupling conductor 123 is formed on a portion of the surface 115 of the substrate 110 on the upper side of the feed conductor 122, having a curved shape fitted to the U-shaped line of the feed conductor 122. An upper end of the coupling conductor 123 is connected to the one end 121*a* of the radiation conductor 121, and a lower end (a curved portion) faces the feed conductor 122 across the gap g with a substantially constant width along the curved line. Because the upper end of the coupling conductor 123 is connected to the radiation conductor 121, it also functions as a part of the radiation conductor 121. Particularly, because a width of the coupling conductor 123 at a connected portion with the radiation conductor 121 is the same as a width of the radiation conductor 121, it is possible to enhance radiation efficiency.

The adjustment conductor 124 is formed on a portion of the surface 112 of the substrate 110, and is connected to a land for adjusting the characteristics on the printed circuit board.

As shown in FIG. 1, the feed conductor 122 includes a coupling portion 122*c* that extends in a direction B while being curved in a substantially U shape. The direction B is a direction orthogonal to the longitudinal direction. The coupling portion 122*c* of the feed conductor 122 is formed on the surface 115, and the feed conductor 122 and the coupling conductor 123 are arranged in parallel with a constant gap therebetween. With this arrangement, the coupling portion 122*c* of the feed conductor 122 and the coupling conductor 123 can be electromagnetically coupled to each other.

It is preferable that these conductor patterns formed on the surfaces of the substrate 110 are formed in bilaterally symmetry with respect to a plane that is parallel to the surfaces 113 and 114 of the substrate 110. With this arrangement, even when a direction of the antenna device 100 is rotated by 180 degrees around an axis (a Z axis) that is perpendicular to the surfaces 111 and 112 of the substrate 110, the shape of the conductor patterns of the antenna device 100 viewed from an end side of the printed circuit board is substantially the same. Therefore, the antenna characteristics are not largely changed depending on a direction of mounting the antenna, making it possible to design the antenna easily.

Figure 3:
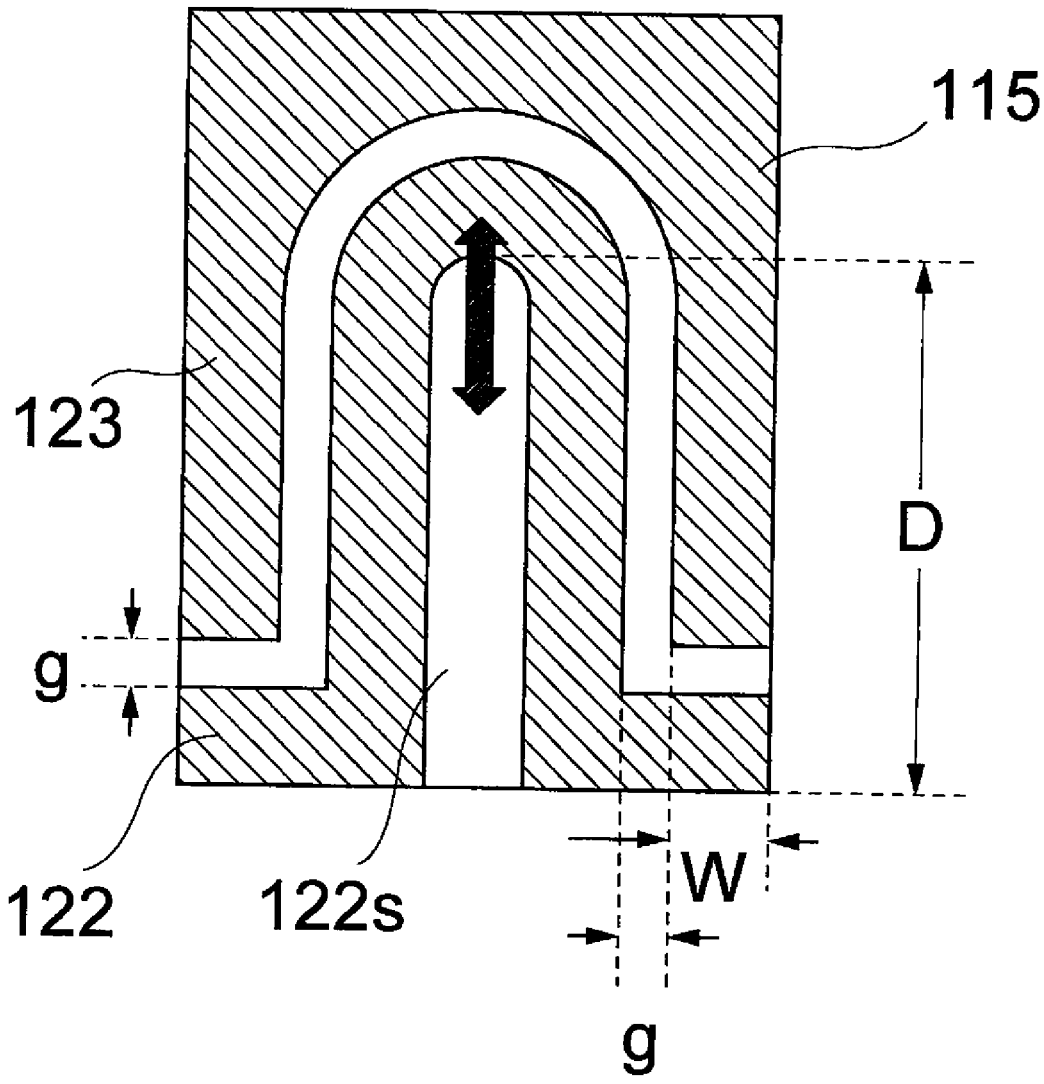
FIG. 3 is an enlarged schematic plan view showing the feed conductor 122 and the coupling conductor 123.

FIG. 3 is a schematic plan view of the feed conductor 122 and the coupling conductor 123.

As shown in FIG. 3, an insulation area (a slit) 122*s* that is necessary for forming the feed conductor 122 as a strip conductor defines the curved shape of the feed conductor 122. However, as indicated by an arrow in the drawing, the impedance can be changed by adjusting the depth or width of the slit 122*s*. Although the electromagnetic coupling may become too strong when the radiation conductor is elongated to downsize the antenna device, it is possible to weaken the coupling by reducing a depth D of the slit 122*s*. An impedance adjustment can also be performed by adjusting the gap width g between the feed conductor 422 and the coupling conductor 123; however, the impedance adjustment by changing the depth or width of the slit 122*s* has an advantage in that it is easier to perform a fine adjustment as compared to the case of adjusting the gap width g.

Figure 4:
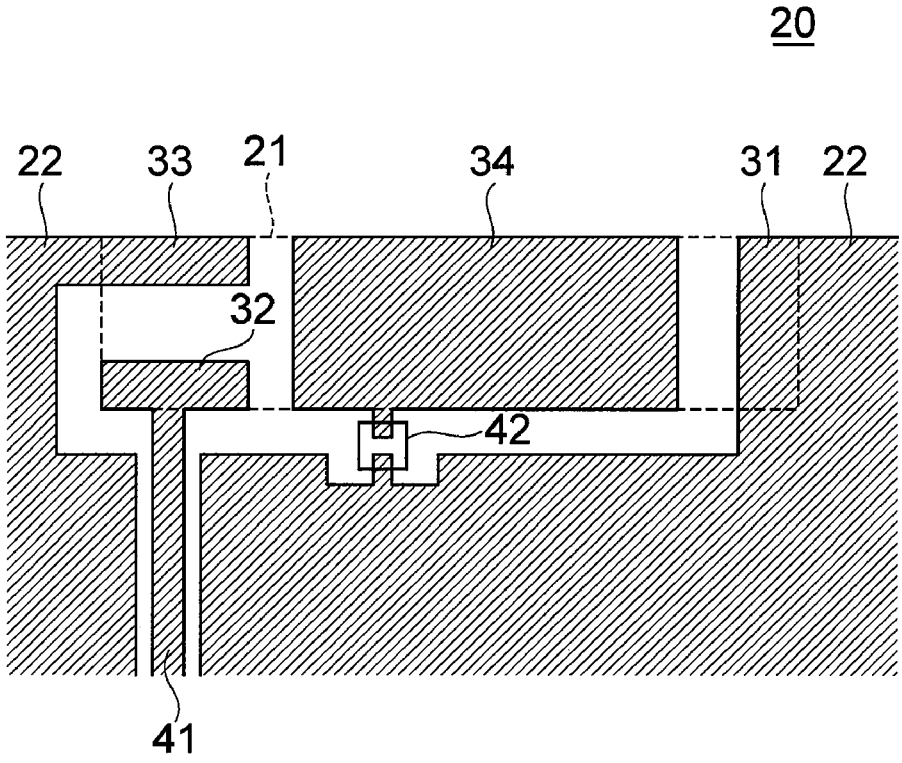
FIG. 4 is a schematic plan view showing a pattern layout on the printed circuit board on which the antenna device 100 is to be mounted.

FIG. 4 is a schematic plan view of a pattern layout on the printed circuit board on which the antenna device 100 is to be mounted.

As shown in FIG. 4, an antenna mounting area 21 that is surrounded by a ground pattern 22 in three directions is formed on a printed circuit board 20. Four lands 31 to 34 are formed inside the antenna mounting area 21, and the antenna device 100 is soldered on these lands 31 to 34.

The land 31 is connected to the other end 121*b* of the radiation conductor 121. The land 32 is connected to the one end 122*a* of the feed conductor 122. The land 33 is connected to the other end 122*b* of the feed conductor 122. The land 34 is connected to the adjustment conductor 124. As shown in FIG. 4, the lands 31 and 33 are connected to the ground pattern 22, and the land 32 is connected to a feed line 41. The land 34 is connected to the ground pattern 22 via an adjustment element 42.

An inductance element or a capacitance element can be used as the adjustment element 42. As is described later, the adjustment element 42 is an element that is added when changing the antenna characteristics. Therefore, the connection of the adjustment element 42 is not essential. In the case of not using the adjustment element 42, the land 34 can be directly connected to the ground pattern 22 or can be placed in a floating state.

Figure 5:
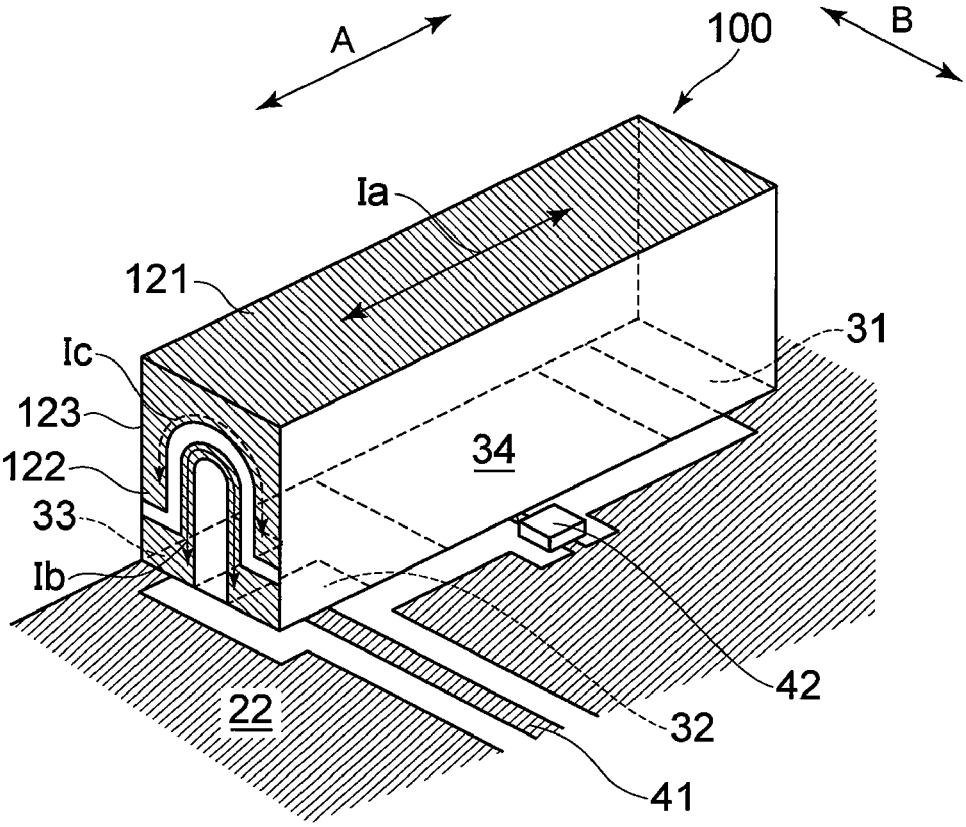
FIG. 5 is a schematic perspective view showing a state where the antenna device 100 is mounted on the printed circuit board 20.

FIG. 5 is a schematic perspective view showing a state where the antenna device 100 is mounted on the printed circuit board 20, which shows a portion of a wireless communication equipment using the antenna device 100.

As shown in FIG. 5, when the antenna device 100 is mounted on the printed circuit board 20, the other end 121*b* of the radiation conductor 121 is connected to the ground pattern 22 via the land 31. Besides, because a signal current is supplied to the one end 121*a* of the radiation conductor 121 via the coupling conductor 123, a radiation current Ia flows through the radiation conductor 121 mainly in the direction A that is the longitudinal direction of the substrate 110.

The one end 122*a* of the feed conductor 122 is connected to the feed line 41 via the land 32, and the other end 122*b* is connected to the ground pattern 22 via the land 33. Therefore, a feed current Ib that is supplied via the feed line 41 flows to the ground pattern 22 via the coupling portion 122*c*. Because the coupling portion 122*c* of the feed conductor 122 and the coupling conductor 123 are connected via a capacitive coupling by the gap, a portion of the feed current Ib flows into the coupling conductor 123 via the capacitive coupling. Particularly, because the coupling portion 122*c* is curved in a U shape so that a range of facing the coupling conductor 123 is wide, a larger capacitive coupling can be obtained.

Further, when the feed current Ib flows through the coupling portion 122*c*, an induction current Ic corresponding to the feed current Ib flows through the coupling conductor 123. As shown in FIG. 5, because the coupling portion 122*c* of the feed conductor 122 and the coupling conductor 123 are extending in the direction B that is orthogonal to the longitudinal direction, the induction current Ic also flows in the direction B. The induction current Ic that flows in the direction B is supplied to the radiation conductor 121 via the coupling conductor 123, and as a result, the radiation current Ia is caused to flow through the radiation conductor 121 in the direction A.

In this manner, in the antenna device 100 according to the present embodiment, because the direction of flow of the radiation current Ia and the direction of flow of the feed current Ib are different from each other by 90 degrees, these currents hardly counteract each other. Therefore, it is possible to prevent a degradation of radiation efficiency caused by the counteracting.

Figure 6:
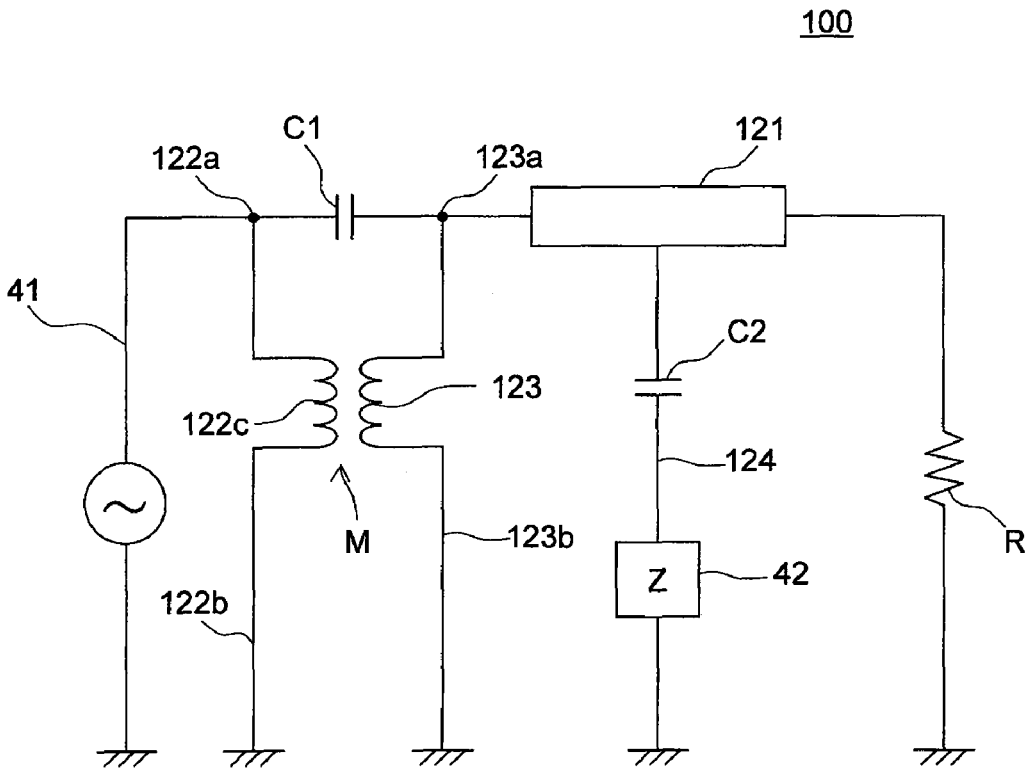
FIG. 6 is an equivalent circuit diagram of the antenna device 100 mounted on the printed circuit board 20.

FIG. 6 is an equivalent circuit diagram of the antenna device 100 when it is mounted on the printed circuit board 20.

As shown in FIG. 6, the antenna device 100 according to the present embodiment constitutes a sort of an inverted F antenna to which a current is supplied by an electromagnetic coupling. Because the feed conductor 122 and the coupling conductor 123 are arranged close to each other, a capacitance C1 is generated between them. Particularly, because the coupling portion 122*c* of the feed conductor 122 is substantially U-shaped so that the range of facing the coupling conductor 123 is wide, it is possible to obtain a large capacitive coupling.

The electromagnetic coupling is achieved by a transformer M that takes the coupling portion 122*c* of the feed conductor 122 as the primary side and the coupling conductor 123 as the secondary side. Furthermore, because the radiation conductor 121 and the adjustment conductor 124 face each other across the substrate 110, a capacitance C2 is generated between them. Therefore, in order to obtain desired antenna characteristics, it is necessary to take the coupling characteristic of the transformer M and a value of the capacitance C2 into consideration as well as a value of the capacitance C1.

As described above, the adjustment conductor 124 can be directly connected to the ground pattern 22 or placed in a floating state. However, when it is necessary to change the antenna characteristics, it is sufficient to connect the adjustment element 42, as shown in FIG. 5. When the adjustment element 42 is connected, a reactance between the radiation conductor 121 and the ground is changed, which makes it possible to change the antenna characteristics in response to the change of the reactance.

As described above, the antenna device 100 according to the present embodiment is an antenna to which a current is supplied by an electromagnetic coupling, in which the direction of flow of the radiation current Ia and the direction of flow of the feed current Ib are different from each other by 90 degrees. Therefore, because the radiation current Ia and the feed current Ib can hardly counteract each other, it is possible to prevent the radiation efficiency from being degraded.

Furthermore, the antenna device 100 according to the present embodiment includes the coupling conductor 123, so that the radiation conductor 121 and the feed conductor 122 are electromagnetically coupled via the coupling conductor 123. Therefore, because the feed current Ib does not directly flow into the radiation conductor 121, it is possible to prevent counteracting between the radiation current Ia and the feed current Ib in a more effective manner.

Moreover, in the antenna device 100 according to the present embodiment, because the feed conductor 122 is a substantially U shape that is gently curved, an electric filed concentration can hardly occur. Particularly, because the length of the feed conductor 122 can be increased by forming the feed conductor 122 in a substantially U shape, it is possible to obtain a strong electromagnetic coupling with the coupling conductor 123. Accordingly, current losses can be suppressed, which makes it possible to enhance the radiation efficiency.

Furthermore, in the antenna device 100 according to the present embodiment, because the radiation conductor 121 is formed on the entire area of the surface 111 that is parallel to the longitudinal direction and the feed conductor 122 and the coupling conductor 123 are formed on a different surface from the surface 111, it is possible to secure enough length and dimension of the radiation conductor 121. Moreover, because the coupling conductor 123 is connected to the radiation conductor 121 with the same width, it is also possible to cause the coupling conductor 123 to function as apart of the radiation conductor 121 in an effective manner. Accordingly, because the principle surface of the substrate can be utilized with high efficiency, it is possible to enhance the radiation efficiency and to downsize the entire antenna device. Furthermore, it is also possible to reduce the electrical resistance of the radiation conductor 121.

Furthermore, because the feed conductor 122 and the coupling conductor 123 are formed on the surface of the substrate 110, it is not necessary to form a through hole and the like in the substrate 110, making it possible to suppress an increase of manufacturing costs.

Figure 7:
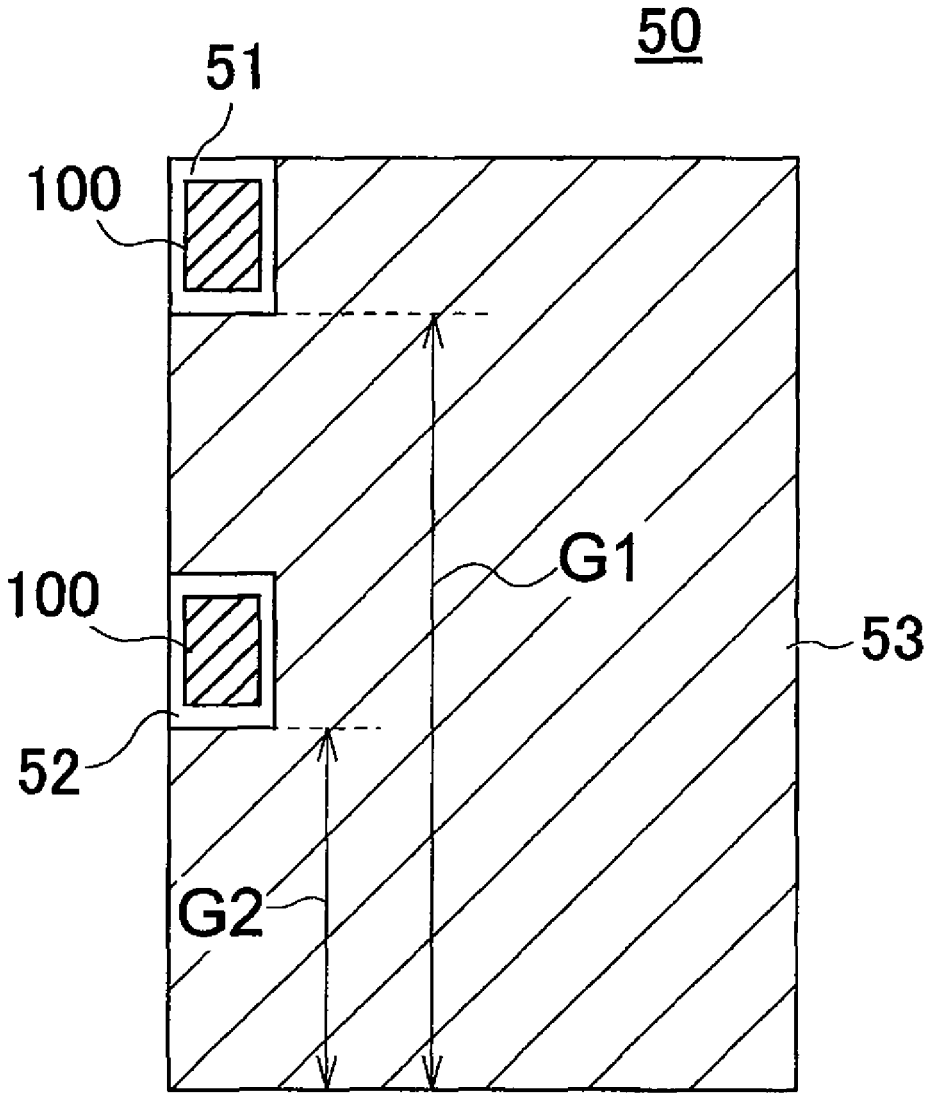
FIG. 7 is a schematic plan view showing an example of mounting the antenna device 100 on a printed circuit board 50 of an on-ground type including a plurality of antenna mounting areas with a ground pattern arranged.

FIG. 7 is a schematic plan view showing an example of mounting the antenna device 100 on a printed circuit board 50 of an on-ground type including a plurality of antenna mounting areas with a ground pattern arranged.

The printed circuit board 50 shown in FIG. 7 includes two antenna mounting areas 51 and 52. The antenna mounting area 51 is located at a corner of the printed circuit board 50, being surrounded by a ground pattern 53 in two directions. On the other hand, the antenna mounting area 52 is located along an edge of the printed circuit board 50, being surrounded by the ground pattern 53 in three directions.

Figure 8A:
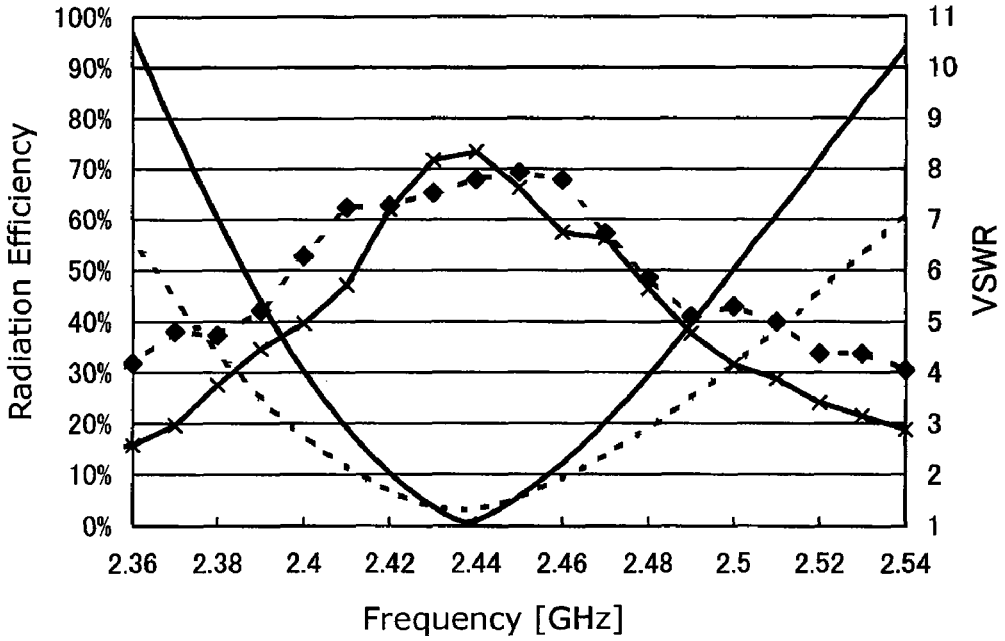
FIGS. 8A and 8B are graphs showing the characteristics of antenna devices mounted on the antenna mounting area 51 and 52, respectively.
Figure 8B:
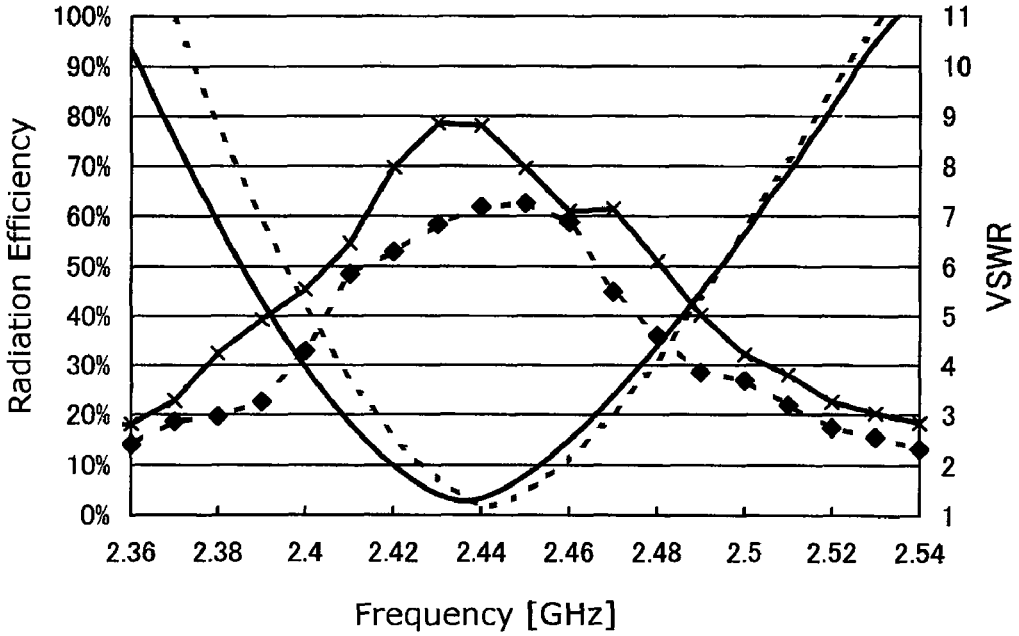
Figure 18:
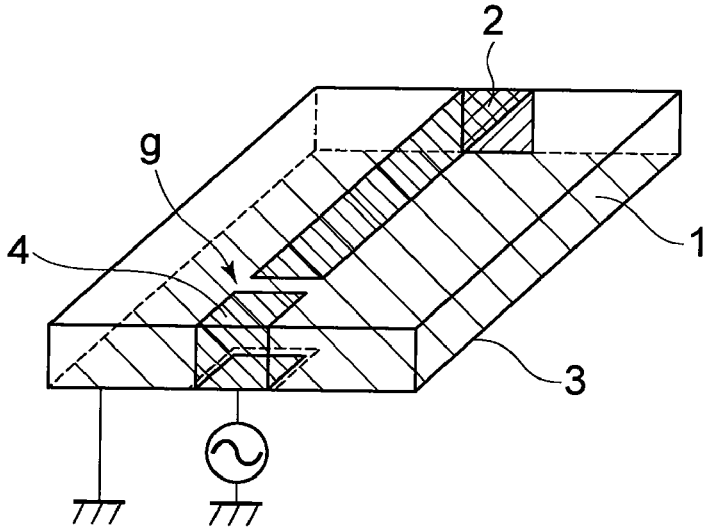
FIG. 18 is a schematic perspective view showing one example of the structure of the conventional antenna device.
Figure 19:
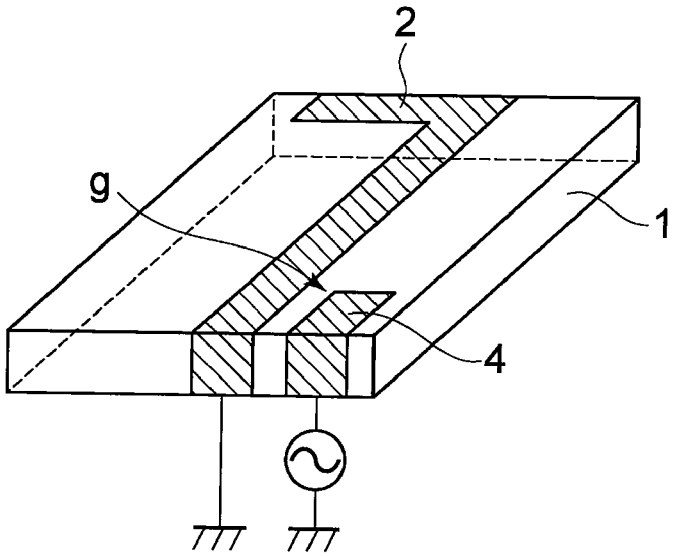
FIG. 19 is a schematic perspective view showing another example of the structure of the conventional antenna device.

FIGS. 8A and 8B shows graphs of the characteristics of antenna devices mounted on the antenna mounting areas 51 and 52, where FIG. 8A shows the characteristics when the antenna device is mounted on the antenna mounting area 51, and FIG. 8B shows the characteristics when the antenna device is mounted on the antenna mounting area 52. In FIGS. 8A and 8B, the characteristics in the case of mounting the antenna device 100 shown in FIG. 1 is represented by a solid line, and the characteristics in the case of mounting the conventional antenna device shown in FIG. 18 is represented by a broken line.

As shown in FIG. 8A, when the antenna device is mounted on the antenna mounting area 51, there is no large difference in the characteristics (radiation efficiency and VSWR) of the two antenna devices. However, as shown in FIG. 8B, when the antenna device is mounted on the antenna mounting area 52, it is found that the characteristics of the conventional antenna device is degraded as compared to the antenna device 100 according to the present invention. It is because a length G2 of the ground pattern 53 viewed from the gap is relatively short when the antenna device is mounted on the antenna mounting area 52, while a length G1 of the ground pattern 53 viewed from the gap is relatively long when the antenna device is mounted on the antenna mounting area 51.

In the case of using the antenna device 100 shown in FIG. 1, the difference in the antenna characteristics due to the mounting position is very small. It is because not only the capacitive coupling using the gap is strong, but also the current is supplied by the inductive coupling. In this manner, with the antenna device 100 according to the present embodiment, it is also possible to suppress a change of the antenna characteristics due to the mounting position on the printed circuit board.

Figure 9:
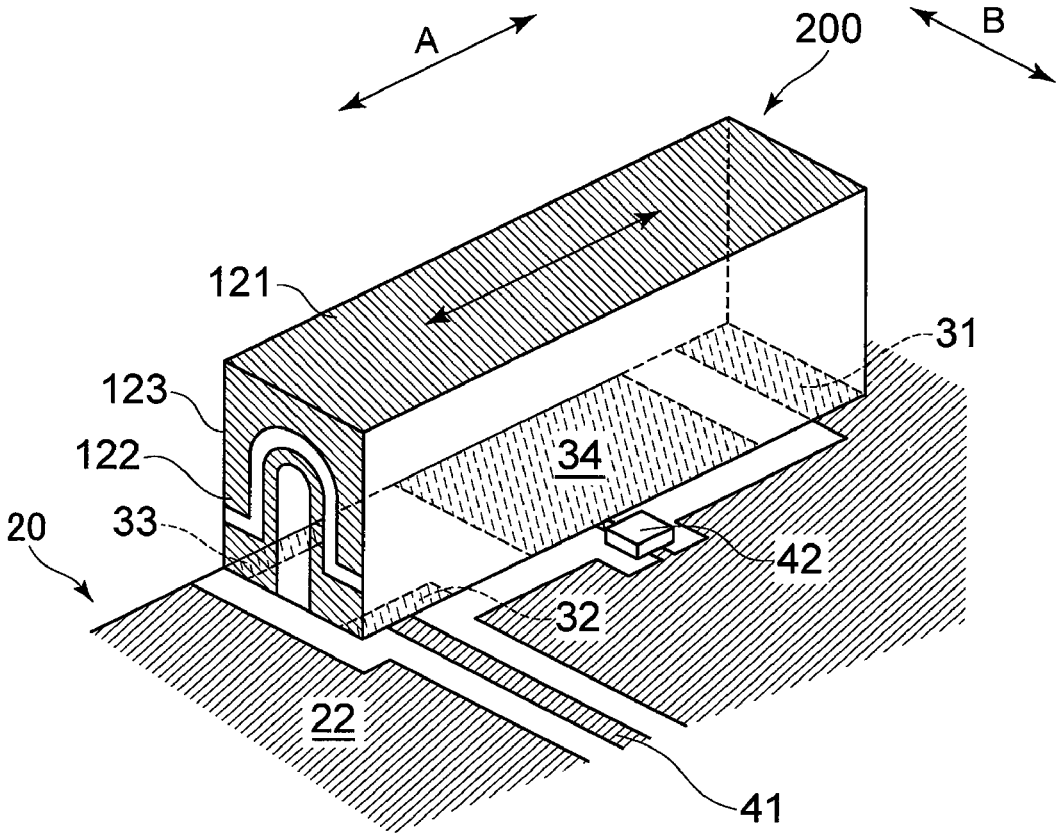
FIG. 9 is a diagram showing an antenna device 200 according to a second embodiment of the present invention, specifically a perspective view showing a state where the antenna device 200 is mounted on a printed circuit board.
Figure 10:
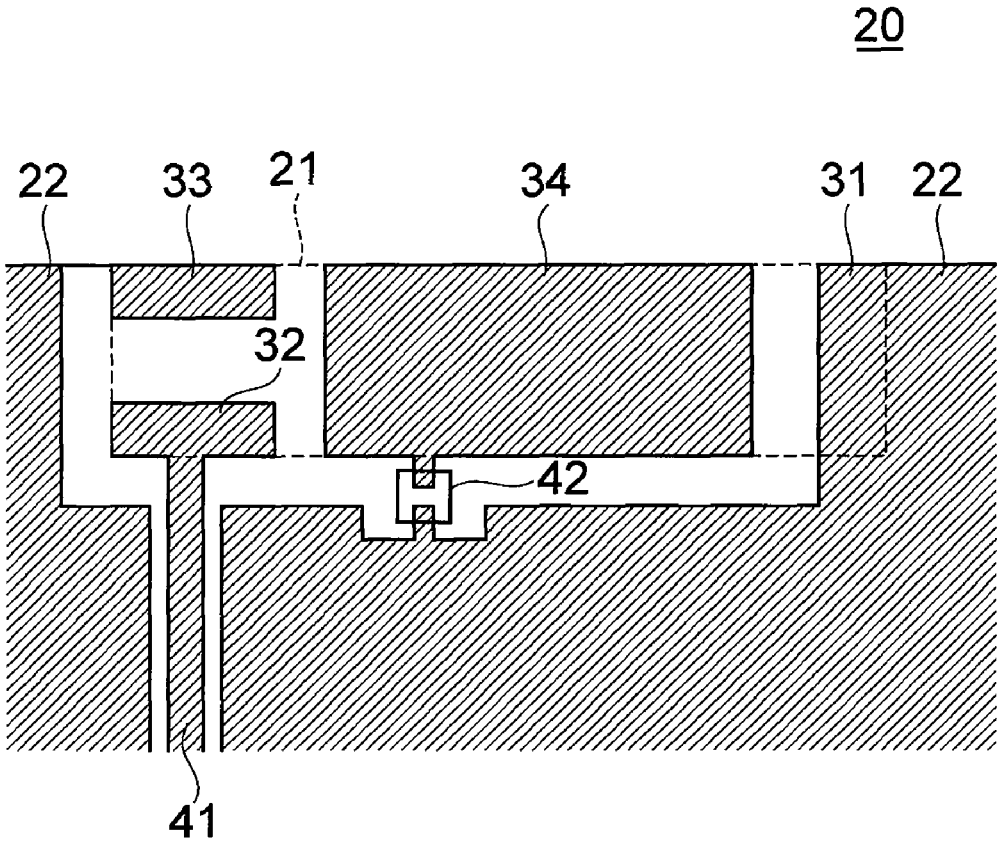
FIG. 10 is a diagram showing an antenna device 200 according to a second embodiment of the present invention, specifically a schematic plan view of a pattern layout on the printed circuit board.

FIGS. 9 and 10 show an antenna device 200 according to a second embodiment of the present invention, where FIG. 9 is a perspective view showing a state where the antenna device 200 is mounted on a printed circuit board, and FIG. 10 is a schematic plan view of a pattern layout on the printed circuit board on which the antenna device 200 is to be mounted.

As shown in FIGS. 9 and 10, the antenna device 200 according to the present embodiment is different from the antenna device 100 in that the land 33 is not connected to the ground pattern 22 on the printed circuit board 20, but is placed in a floating state. Other than this difference, the antenna device 200 has the same configuration as that of the antenna device 100. Therefore, like elements are denoted by like reference numerals, and redundant explanations thereof will be omitted.

When the land 33 is in a floating state, the one end 122*a* of the feed conductor 122 is not grounded at the time of mounting the antenna device 200, but is left in an open state. In this manner, by opening the other end 122*b* of the feed conductor 122, which is normally connected to the ground, it is possible to change the impedance of the antenna. With this configuration, it is possible to use the antenna device as an impedance adjusting unit when incorporating the antenna device in a cellular phone and the like.

Figure 11A:
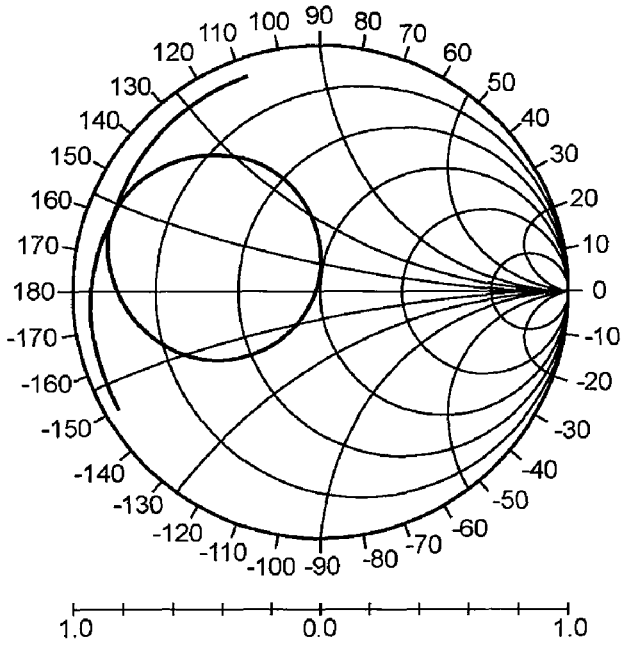
FIGS. 11A and 11B are graphs showing a change of the impedance characteristic of the antenna device when the land 33 is short circuited (see FIG. 4), specifically
Figure 11B:
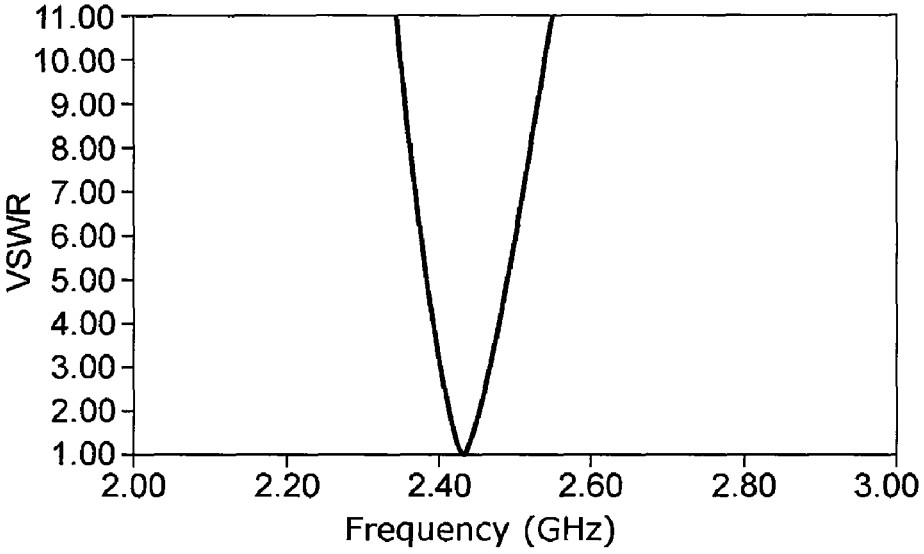
Figure 12A:
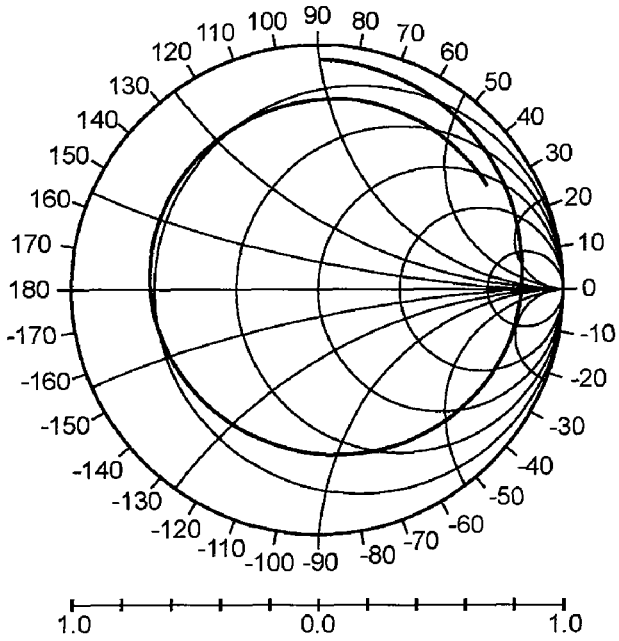
FIGS. 12A and 12B are graphs showing a change of the impedance characteristic of the antenna device when the land 33 is in a floating state (an open state, see FIG. 10), specifically
Figure 12B:
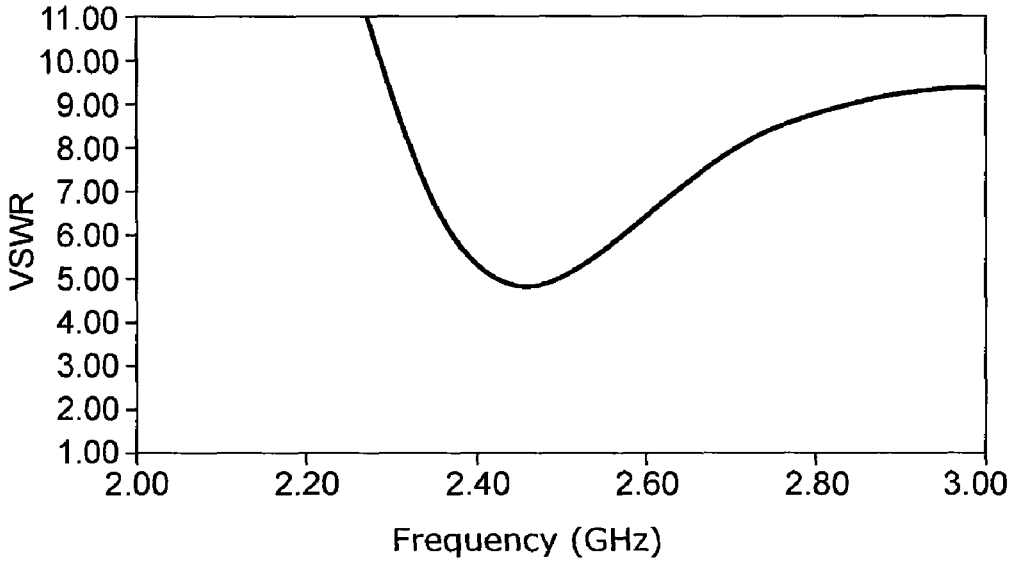

FIGS. 11 and 12 are graphs showing a change of the impedance characteristic of the antenna device, where FIGS. 11A and 11B show graphs when the land 33 is short circuited (see FIG. 4), and FIGS. 12A and 12B show graphs when the land 33 is in a floating state (an open state, see FIG. 10). FIGS. 11A and 12A are smith charts, and FIGS. 11B and 12B are VSWR characteristic diagrams.

As shown in FIGS. 11 and 12, the impedance characteristic of the antenna device is largely different between a short state and an open state. Particularly, as shown in FIG. 11B, when the land 33 is short circuited, the change of the impedance characteristic is relatively small, and the VSWR characteristic shows a sharp peak near 2.4 GHz. However, when the land is opened, the change of the impedance characteristic is relatively large, and the VSWR characteristic shows a moderate peak near 2.4 GHz. In this manner, because the impedance characteristic of the antenna device is largely changed depending on the connection state of the land 33, it is possible to use the connection state of the land 33 as an impedance adjusting unit of the antenna device. Furthermore, in response to a change of the impedance at the time of being used, it is also possible to change the connection state of the feed conductor 122 in an active manner.

Figure 13:
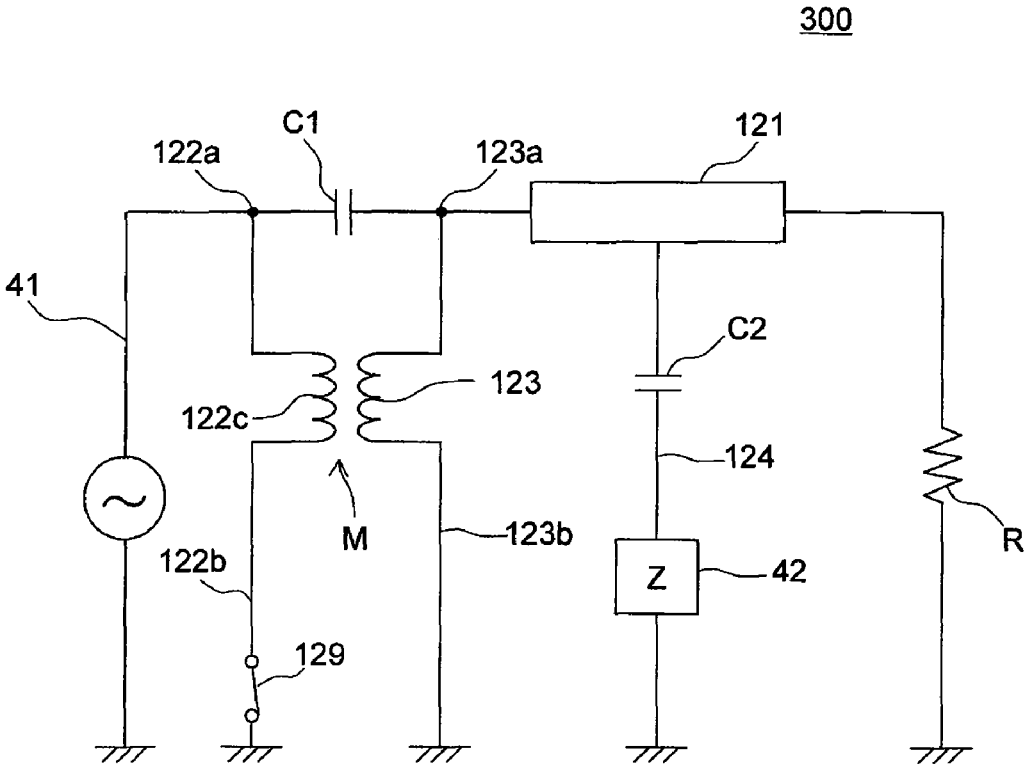
FIG. 13 shows a configuration of an antenna device 300 according to a third embodiment of the present invention, which is an equivalent circuit diagram when the antenna device 300 is mounted on a printed circuit board 20.

FIG. 13 shows a configuration of an antenna device 300 according to a third embodiment of the present invention, which is an equivalent circuit diagram when the antenna device 300 is mounted on a printed circuit board 20.

As shown in FIG. 13, the antenna device 300 according to the present embodiment is different from the antenna device 100 in that the antenna device 300 further includes a switching unit 129 that grounds or opens the other end 122*b* of the feed conductor 122. Other than this difference, the antenna device 300 has the same configuration as that of the antenna device 100. Therefore, like elements are denoted by like reference numerals, and redundant explanations thereof will be omitted.

The switching unit 129 shown in FIG. 13 is grounded in an ON state, and is opened in an OFF state. Although it is not particularly limited to, for example, a transistor can be used as the switching unit 129. A switching timing of the switching unit 129 can be adjusted depending on a change of wave condition around the antenna. For example, when the wave condition is changed according to an opening and closing condition of a folding-type cellular phone, the switching can be performed in conjunction with the opening and closing state. Alternatively, the switching can be performed according to whether the cellular phone is being operated (or whether the cellular phone is held in hand).

In the manner, because the antenna device 300 includes the switching unit 129 that grounds or opens the other end 122*b* of the feed conductor 122, it is possible to change the connection state of the feed conductor 122 in an active manner according to a change of the antenna impedance at the time of being used, making it possible to keep the antenna characteristics even when the condition around the antenna is changed. The connection state of the feed conductor 122 is not limited to the ground state and the open state, but the feed conductor 122 can also be short circuited via a predetermined resistor.

Figure 14:
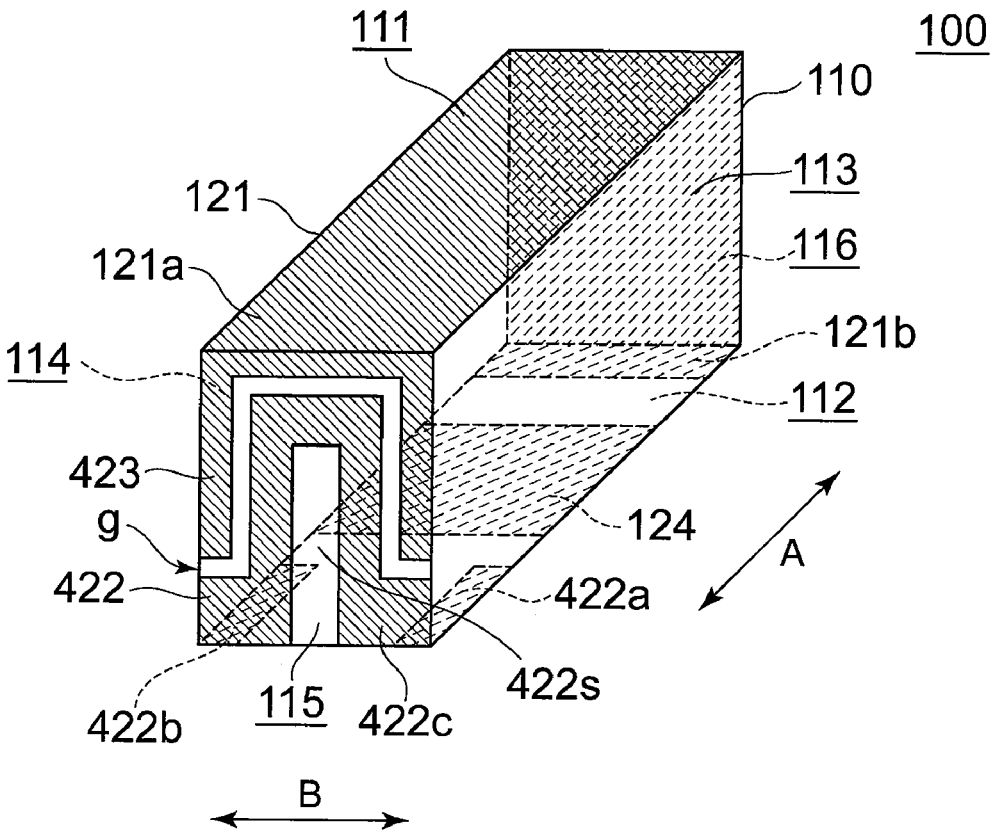
FIG. 14 is a schematic perspective view showing an antenna device 400 according to a preferred fourth embodiment of the present invention.
Figure 15:
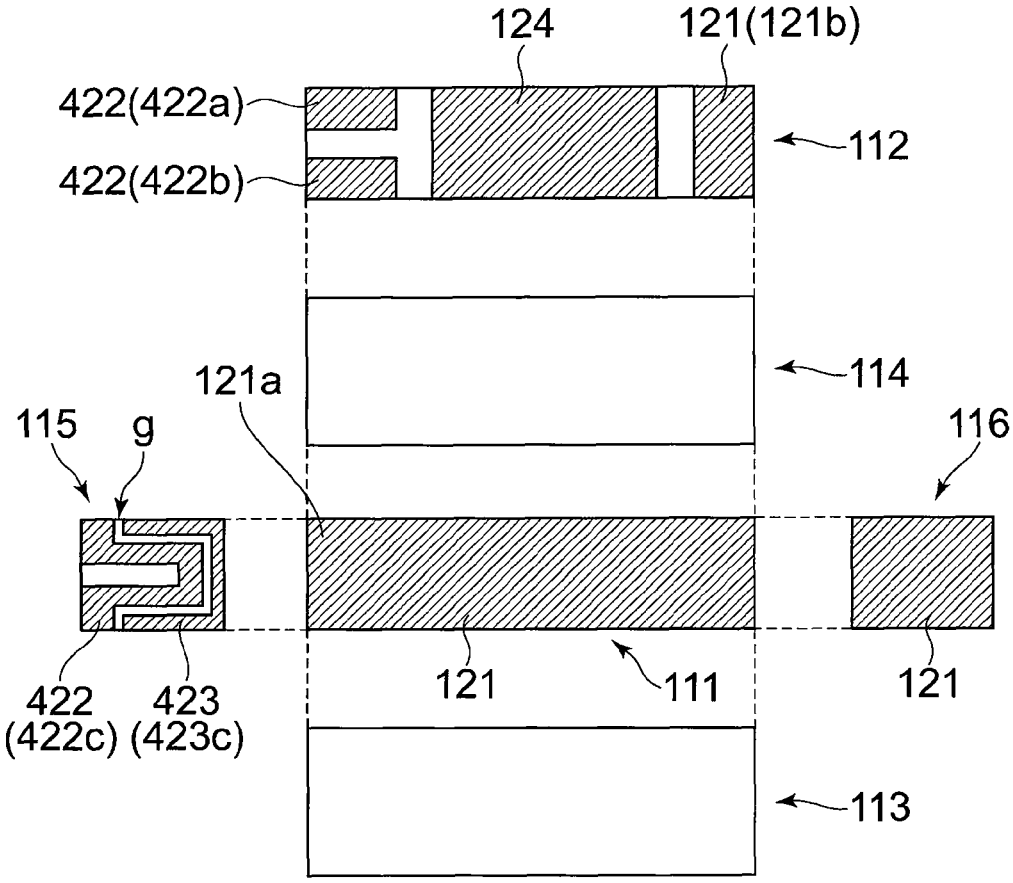
FIG. 15 is a development view of the antenna device 400.

FIG. 14 is a schematic perspective view of an antenna device 400 according to a preferred fourth embodiment of the present invention, and FIG. 15 is a development view of the antenna device 400.

As shown in FIGS. 14 and 15, the antenna device 400 according to the present embodiment includes a substantially U-shaped feed conductor 422. The U-shaped portion of the feed conductor 422 is not a rounded shape that is gently curved, but a bent shape (one side open rectangle) that is flexed to a right angle. Furthermore, a coupling conductor 423 has a bent shape fitted to the open rectangular shape of the feed conductor 422. With this configuration, the feed conductor 422 and the coupling conductor 423 are capacitively coupled via the gap g having a bent shape that is flexed to a right angle. An upper end of the coupling conductor 423 is connected to the one end 121*a* of the radiation conductor 121, and a lower end (a flexed portion) faces the feed conductor 422 across the gap g with a substantially constant width. Other configurations are substantially the same as those of the antenna device 100 according to the first embodiment. Therefore, like elements are denoted by like reference numerals, and detailed explanations thereof will be omitted.

Figure 16:
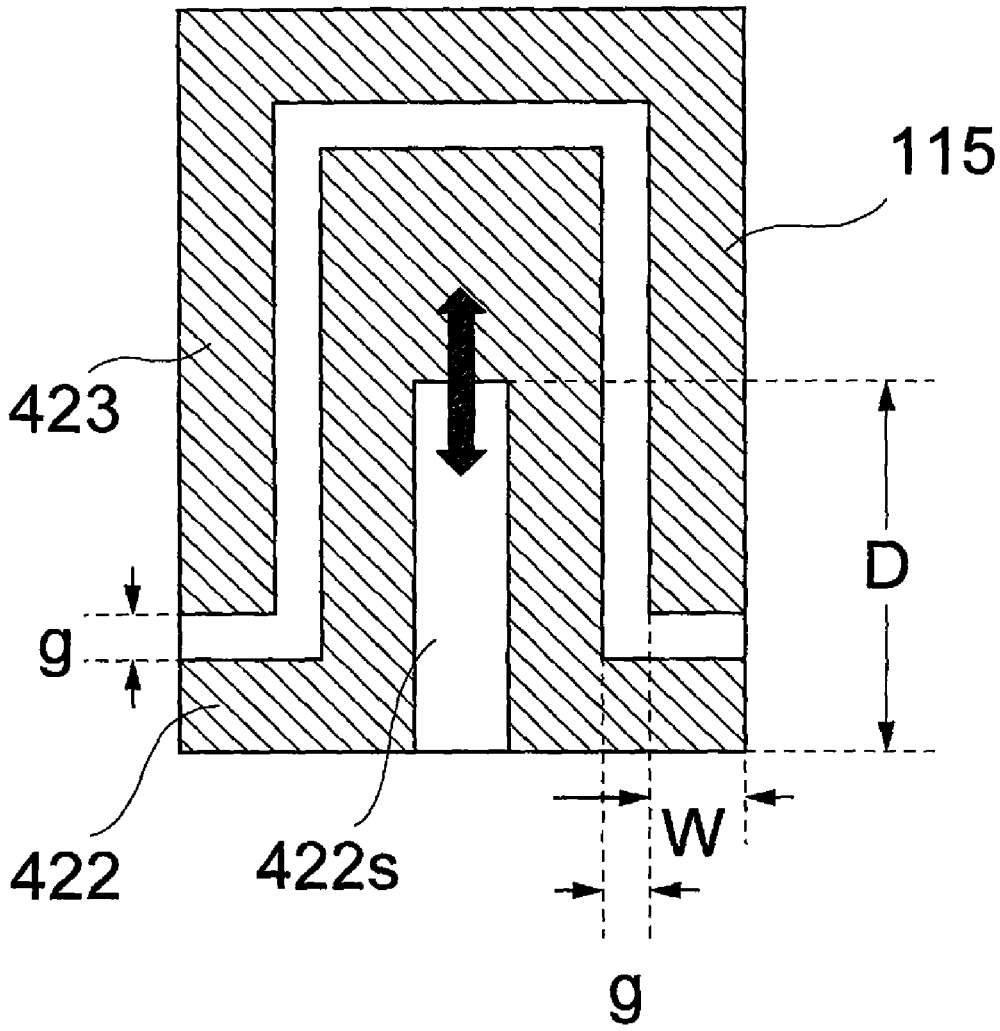
FIG. 16 is an enlarged schematic plan view of the feed conductor 422 and the coupling conductor 423.
Figure 17:
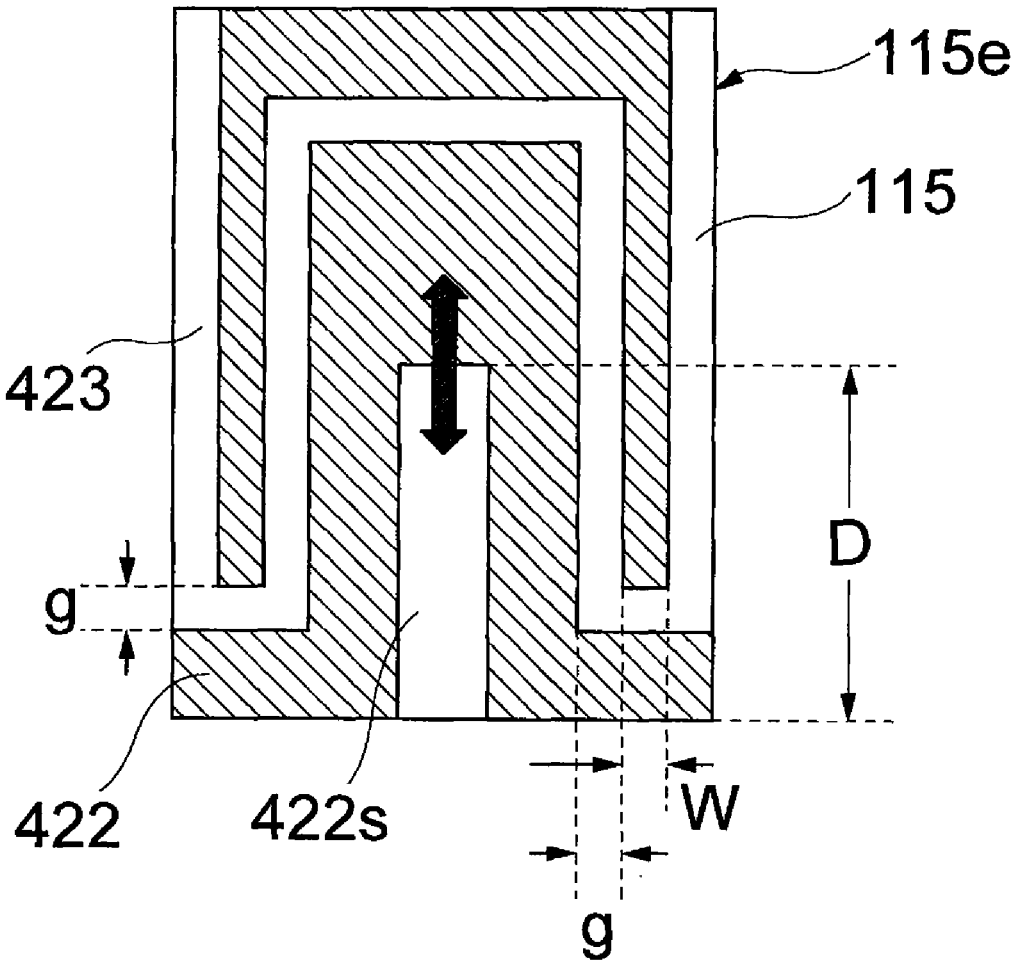
FIG. 17 is an enlarged schematic plan view of a modification example of the feed conductor 422 and the coupling conductor 423.

FIG. 16 is an enlarged schematic plan view of the feed conductor 422 and the coupling conductor 423, and FIG. 17 is an enlarged schematic plan view of a modification example of the feed conductor 422 and the coupling conductor 423.

As shown in FIG. 16, an insulation area (a slit) 422*s* that is necessary for forming the feed conductor 422 as a strip conductor defines the curved shape of the feed conductor 422. However, as indicated by an arrow in the drawing, the impedance can be changed by adjusting the depth or width of the slit 422*s*. Although the electromagnetic coupling may become too strong when the radiation conductor is elongated to downsize the antenna device, it is possible to weaken the coupling by reducing a depth D of the slit 422*s*. An impedance adjustment can also be performed by adjusting the gap width g between the feed conductor 422 and the coupling conductor 423; however, the impedance adjustment by changing the depth or width of the slit 422*s* has an advantage in that it is easier to perform a fine adjustment as compared to the case of adjusting the gap width g.

Furthermore, it is possible to adjust the impedance by changing a width W of a portion that extends in an orthogonal direction (an up and down direction) to the direction B of the coupling conductor 423. It is preferable that the conductor width W is equal to or wider than 0.5 times the gap g and equal to or narrower than three times the gap g. When the conductor width W is narrower than 0.5 times the gap g, the electromagnetic coupling becomes too strong, and when the conductor width W exceeds three times the gap g, the electromagnetic coupling becomes too weak. When narrowing the conductor width W while satisfying this condition, as shown in FIG. 17, the conductor can be formed on the inward side of an edge 115*e* of the surface 115 of a substrate rather than forming it along the edge 115*e*.

In this manner, in the antenna device 400 according to the present embodiment, because the feed conductor 422 and the coupling conductor 423 are capacitively coupled via the gap of a bent shape that is flexed to a right angle, it is possible to obtain a stronger capacitive coupling than that obtained in the case of the gently curved gap. Furthermore, it is possible to adjust the impedance by changing the height and width of the slit 422*s* that is provided for forming the feed conductor 422 as a strip conductor.

Although the embodiments of the present invention are described above, the invention is not limited to the embodiments. Various modifications can be made without departing from the scope of the present invention, and obviously the modifications are included in the scope of the present invention.

For example, although the antenna devices according to the above embodiments include a substrate of a rectangular cuboid, this aspect is not essential in the present invention. Therefore, the substrate can be a square cubic or a cylinder. Furthermore, a tapered structure can be provided at a corner of the rectangular cuboid to define the direction of the substrate.

Furthermore, although the dielectric is used as the material for the substrate in the above embodiments, other magnetic materials having a dielectric property can be used instead. In this case, because a wavelength shortening effect of $1/\{(\in\times\mu)^{1/2}\}$ is obtained, it is possible to obtain a large wavelength shortening effect by using a magnetic material having a large magnetic permeability μ.

Moreover, in the antenna device according to the above embodiments, although the direction of flow of the radiation current Ia and the direction of flow of the feed current Ib make an angle of 90 degrees, it is not essential that the angle is 90 degrees in the present invention. It suffices as far as these current directions are at least different from each other. However, in order to most effectively prevent counteracting between the radiation current Ia and the feed current Ib, as mentioned in the above embodiments, it is most preferable that the angle is set to 90 degrees.

Although each of the antenna devices according to the above embodiments includes the adjustment conductor 124, it is not essential that the adjustment conductor 124 is provided in the present invention, and it can be omitted.

Although each of the antenna devices according to the above embodiments is an inverted F antenna, it is not essential that the antenna device of the present invention is an inverted F antenna, and it can be of other types.

20 printed circuit board
21 antenna mounting area
22 ground pattern
31-34 land
41 feed line
42 adjustment element
50 printed circuit board
51,52 mounting area
53 ground pattern
100 antenna device
110 substrate
111 upper surface of substrate
112-116 side surface of substrate
121 radiation conductor
121*a* one end of radiation conductor
121*b* other end of radiation conductor
122 feed conductor
122*a* one end of feed conductor
122*b* other end of feed conductor
122*c* coupling portion of feed conductor
122*s* slit
123 coupling conductor
124 adjustment conductor
129 switching unit
200 antenna device
300 antenna device
400 antenna device
422 feed conductor
422*a* one end of feed conductor
422*b* other end of feed conductor
422*c* coupling portion of feed conductor
422*s* slit
423 coupling conductor
C1,C2 capacitance
g gap
Ia radiation current
Ib feed current
Ic induction current
M transformer

What is claimed is:

1. An antenna device, comprising:

a substrate that is made of a dielectric or magnetic material; and a conductor pattern that is formed on the substrate, wherein the conductor pattern includes a radiation conductor, a substantially U-shaped feed conductor, and a coupling conductor that is connected to one end of the radiation conductor and electromagnetically coupled to the feed conductor, the feed conductor and the coupling conductor are conductor patterns formed on a different surface from a surface on which the radiation conductor is formed, and a direction of a radiation current flowing through the radiation conductor and a direction of a feed current flowing through the feed conductor are different from each other.

2. The antenna device as claimed in claim 1, wherein one end of the feed conductor is connected to a feed line and the other end of the feed conductor is grounded.

3. The antenna device as claimed in claim 1, wherein one end of the feed conductor is connected to the feed line and other end of the feed conductor is opened.

4. The antenna device as claimed in claim 1, wherein one end of the feed conductor is connected to the feed line and other end of the feed conductor is grounded or opened via a switching unit.

5. The antenna device as claimed in claim 1, wherein a direction of the radiation current flow and a direction of the feed current flow are substantially orthogonal to each other.

6. The antenna device as claimed in claim 1, wherein the substrate is substantially a rectangular cuboid shape, at least a portion of the radiation conductor is formed on a top surface of the substrate, the feed conductor and the coupling conductor are formed on a first side surface that is orthogonal to a longitudinal direction of the substrate.

7. The antenna device as claimed in claim 1, wherein the conductor pattern that is formed on the substrate is bilaterally symmetric with respect to a predetermined reference surface.

8. The antenna device as claimed in claim 1, wherein the substantially U-shaped portion of the feed conductor has a rounded shape that is gently curved.

9. The antenna device as claimed in claim 1, wherein the substantially U-shaped portion of the feed conductor has a bent shape that is flexed to a right angle.

10. A wireless communication equipment, comprising: a printed circuit board; and the antenna device as claimed in claim 1 that is mounted on the printed circuit board.

11. A wireless communication equipment as claimed in claim 10, wherein the printed circuit board includes a ground pattern, and other end of the radiation conductor is coupled to the ground pattern on the printed circuit board.

12. A wireless communication equipment as claimed in claim 10, wherein the printed circuit board further includes a antenna mounting area, and the antenna mounting area is surrounded by the ground pattern in at least two directions.

* * * * *